US006459859B1

(12) United States Patent
Regelsberger et al.

(10) Patent No.: US 6,459,859 B1
(45) Date of Patent: Oct. 1, 2002

(54) SERVICE ROUTINE TO IDENTIFY CAUSES FOR IMAGE ARTIFACTS IN PRINTED OUTPUT

(75) Inventors: Matthias H. Regelsberger, Rochester, NY (US); David Hockey, Brockport, NY (US)

(73) Assignee: Heidelberg Digital L.L.C., Rochester, NY (US)

( * ) Notice: Subject to any disclaimer, the term of this patent is extended or adjusted under 35 U.S.C. 154(b) by 0 days.

(21) Appl. No.: 09/947,015

(22) Filed: Sep. 5, 2001

(51) Int. Cl.[7] ..... G03G 15/001
(52) U.S. Cl. ..... 399/11; 399/15; 399/159
(58) Field of Search ..... 347/240, 251; 399/11, 15, 18, 49, 60, 72, 159

(56) References Cited

U.S. PATENT DOCUMENTS 6,147,698 A * 11/2000 Zable et al. ..... 347/240
6,349,185 B1 * 2/2002 Burkes et al. ..... 399/49

* cited by examiner

*Primary Examiner*—Arthur T. Grimley
*Assistant Examiner*—Hoang Ngo
(74) *Attorney, Agent, or Firm*—Thomas R. FitzGerald, Esq.

(57) ABSTRACT

A method and apparatus for identifying the root causes of image artifacts visible in the printed output of an electrophotographic printer, activating a special operating mode for the marking engine, and referencing the printing process intentionally to each rotating member of the electrophotographic process in turn. The referencing insures that image artifacts and/or non-uniformities originating from each rotating member are visible in the same location on each printed output. Since the rotating members employed are intentionally designed to be different in diameter, the referencing of the printing process to each one of the rotating members in conjunction with variable receiver sizes enables an operator to associate each image artifact or non-uniformity with a specific rotating member causing it. The appearance of image artifacts is enhanced through zero offset voltage printing and flat-field exposure of the rotating member images as appropriate. Where referencing of the printing process cannot be done,master timing marks are printed on the rotating member images to guide the image interpretation.

37 Claims, 10 Drawing Sheets

SERVICE ROUTINE TO IDENTIFY CAUSES FOR IMAGE ARTIFACTS IN PRINTED OUTPUT

FIELD OF INVENTION

This invention relates to electrophotographic printing, and more specifically to diagnostic operation of electrophotographic printers.

DISCUSSION OF PRIOR ART

Special service and diagnostic programs are stored and used on many printer marking engines to assist the field engineer in the correct and efficient troubleshooting of the marking engine and its subsystems. All these programs are designed and implemented to minimize the total service time. Minimizing the total service time minimizes the cost of service to the service organization as well as the loss in productivity to the owner of the equipment. Special service and diagnostic routines for the electrophotographic image formation and image development process are especially valuable, since this multi-step process conditions the photosensitive receiver electrically, making visual inspection under ambient light impossible. Paper handling problems and others, by contrast, can be observed and corrected using ambient lighting.

SUMMARY

This invention facilitates identification of the root causes of, and the particular rotating member responsible for, image artifacts visible in the printed output of an electrophotographic printer. The program of the invention establishes a special operating mode for the marking engine, referencing the printing process intentionally to each rotating member of the electrophotographic process in turn. The referencing insures that image artifacts and/or non-uniformities originating from each rotating member are visible in the same location on each printed output. Since the rotating members employed are intentionally designed to be different in diameter, the special program according to this invention es the printing process to each one of the rotating members in conjunction with variable receiver sizes, enabling an operator to associate each image artifact or non-uniformity with a specific rotating member causing it. The invention's special operating mode enhances the appearance of image artifacts through zero offset voltage printing and flat-field exposure of the rotating member images as appropriate. Where referencing of the printing process cannot be done, the invention prints master timing marks on the rotating member images to guide the image interpretation.

The invention's special printing mode is necessarily avoided during normal print production so that image variations and/or artifacts are never in the same location on each printed output, the non-uniform wear of rotating members is minimized, and the useful life of such components is effectively extended.

DETAILED DESCRIPTION OF INVENTION

This invention is used to identify the root causes of image artifacts visible in the printed output. The electrophotographic printing process is a multi-step process including as fundamental steps: 1) the electrical conditioning of the photoconductor, 2) its exposure with a latent image, 3) the development of the latent image with toner or ink, 4) the transfer of said toner or ink to a receiver and 5) the fixing of said toner to the receiver. For print production equipment, a continuous process is typically employed using rotating members to apply and execute each of the above steps repeatedly, consistently and without discernible loss of image quality in the printed output.

The program of this invention intentionally references the printing process to each rotating member of the electrophotographic process in turn, so that image artifacts and/or non-uniformities originating from a particular rotating member are visible in the same location on each printed output. Since the rotating members employed are intentionally designed to be different in diameter, the special program according to this invention provides the ability to reference the printing process to each one of the rotating members in conjunction with variable receiver sizes.

In contrast to the invention, normal print production avoids referencing with rotating members so that image variations and/or artifacts are never in the same location on each printed output. Avoiding such referencing in the most heavily used operating modes minimizes the non-uniform wear of rotating members and extends their useful life.

Figure 1A:
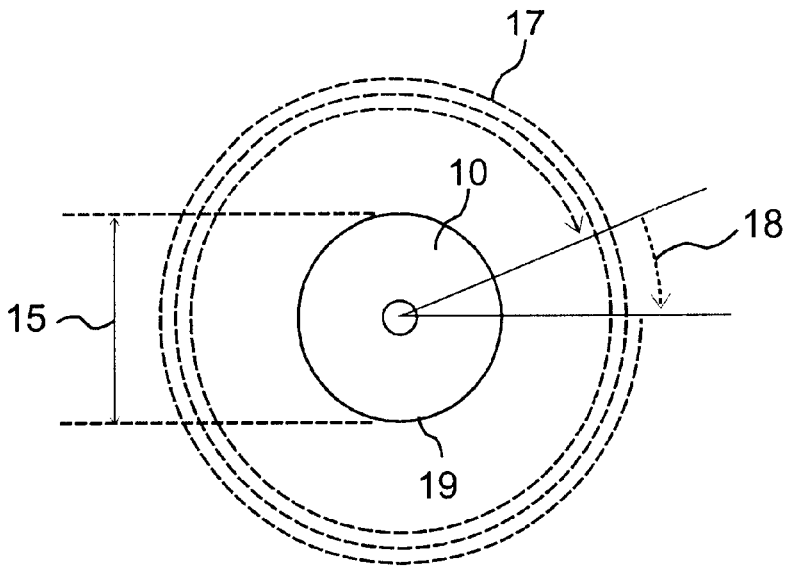
FIG. 1*a* shows a rotating member for which a receiver can contain two complete images.
Figure 1B:
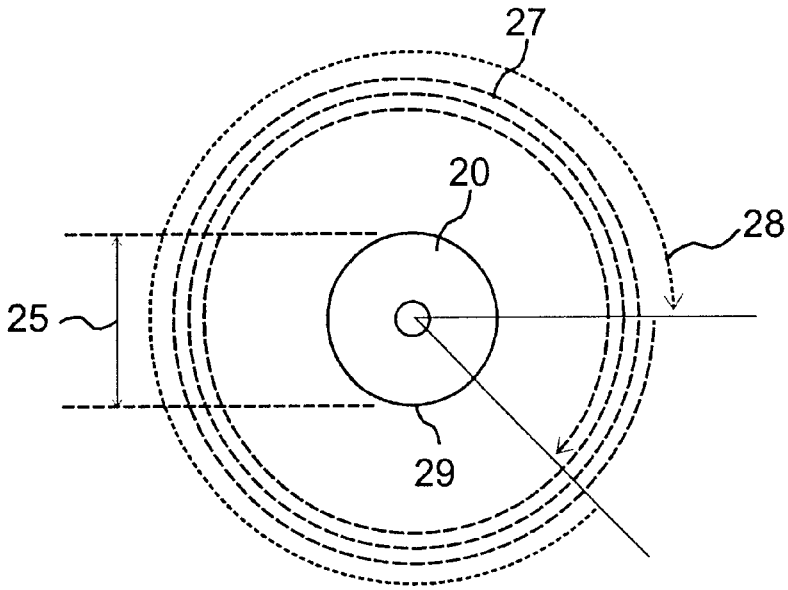
FIG. 1*b* shows a second rotating member for which a receiver can contain three complete images.

According to this invention, a service program sets the logic and control unit of the marking engine to reference the feeding of print receivers to integral multiples of the circumference of the rotating members employed in the printing process. See FIG. 1*a,* showing rotating member 10 with diameter 15, a measure 17 of the length of a receiving member wrapped around rotating member 10, and a measure 18 of the interframe space necessary to combine with measure 17 to complete a measure equal to an integral multiple of the circumference 19 of rotating member 10. As shown, the receiver size 17 ($S_{rec}$) added to the interframe size 18 ($S_{Interframe}$) between successive receivers is an integral multiple of the circumference of the rotating member 10. The invention provides for variation in receiver size $S_{rec}$, and provides for variation in the interframe size $S_{Interframe}$ by changing the actual rate with which the receivers are fed to the printing process to satisfy the above condition. FIG. 1*b* shows a rotating member 20 for which interframe size 28 constitutes a measure nearly equal to the measure of the full circumference 29 of rotating member 20. In general, with the diameter of a rotating member ($d_{rot_member}$) given by its design, and the receiver size $S_{rec}$ known either by direct measurement or by the use of detection sensors within the marking engine, the following equation must be satisfied:

$$S_{rec}+S_{Interframe}=N*\pi*d_{rot_member} \quad \text{(Equ. 1a)}$$

or, solving for $S_{Interframe}$, $$S_{Interframe}=N*\pi*d_{rot_member}-S_{rec} \quad \text{(Equ. 1b)}$$

For rotating members of circumference$\pi*d_{rot_member}$ less than the receiver length $S_{rec}$, the value of N is the integral number of full revolutions imaged onto one receiver.

Although the selection of the integer N is not restricted to satisfy the equation, practical considerations suggest making the integer N as small as necessary to satisfy the above condition. The value for the smallest N is given by:

$$N=\text{INTEGER}\ [(\pi*d_{rot_member}/S_{rec})+1] \quad \text{(Equ.2)}$$

Since the term in [ ] produces in general a rational number, the INTEGER-operand signifies that only the integer portion of the rational number is taken and considered for N.

Figure 2A:
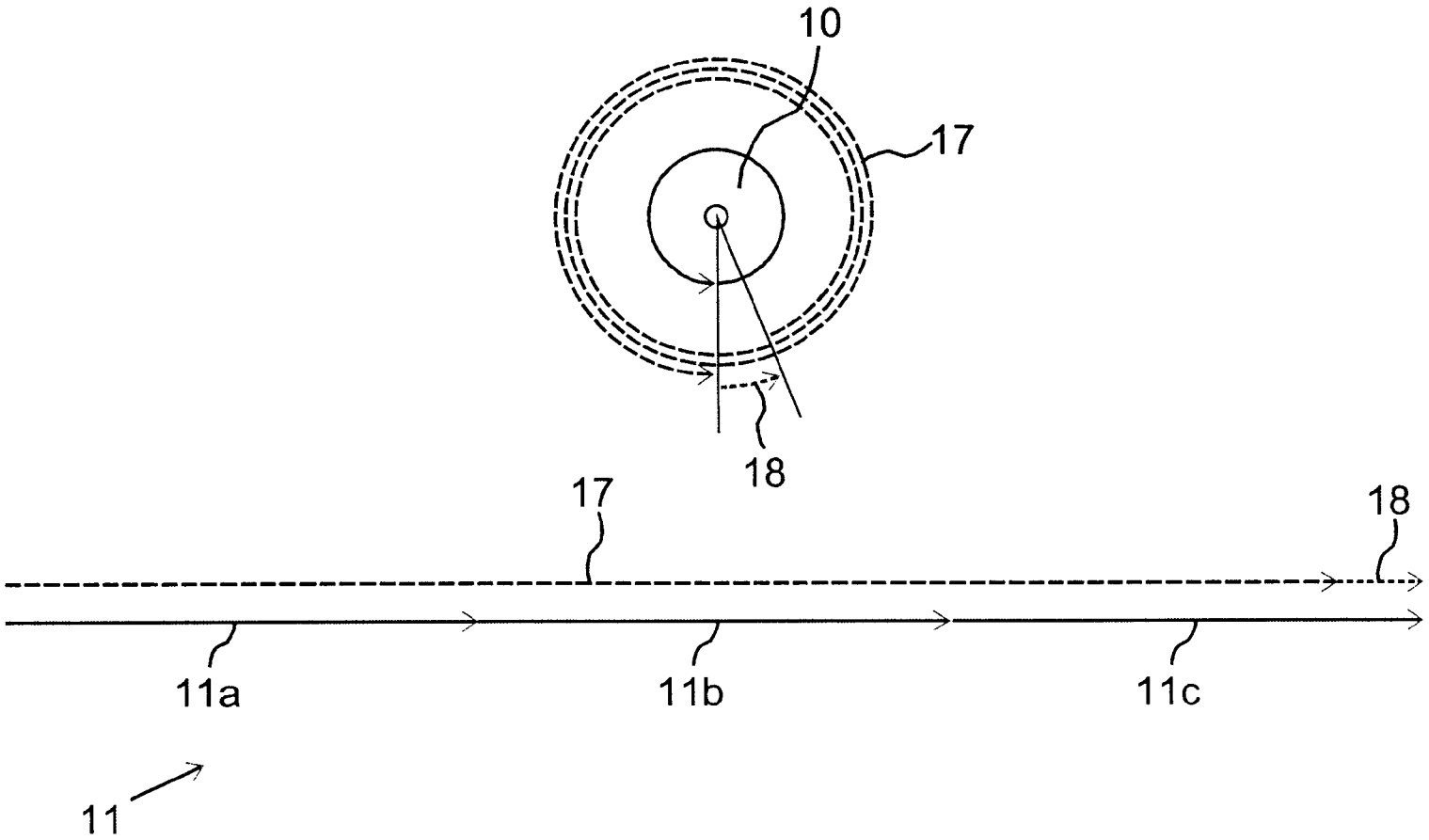
FIG. 2*a* shows a rotating member for which a receiver can contain two complete images, and the projection of those images onto a single flat receiver.
Figure 2B:
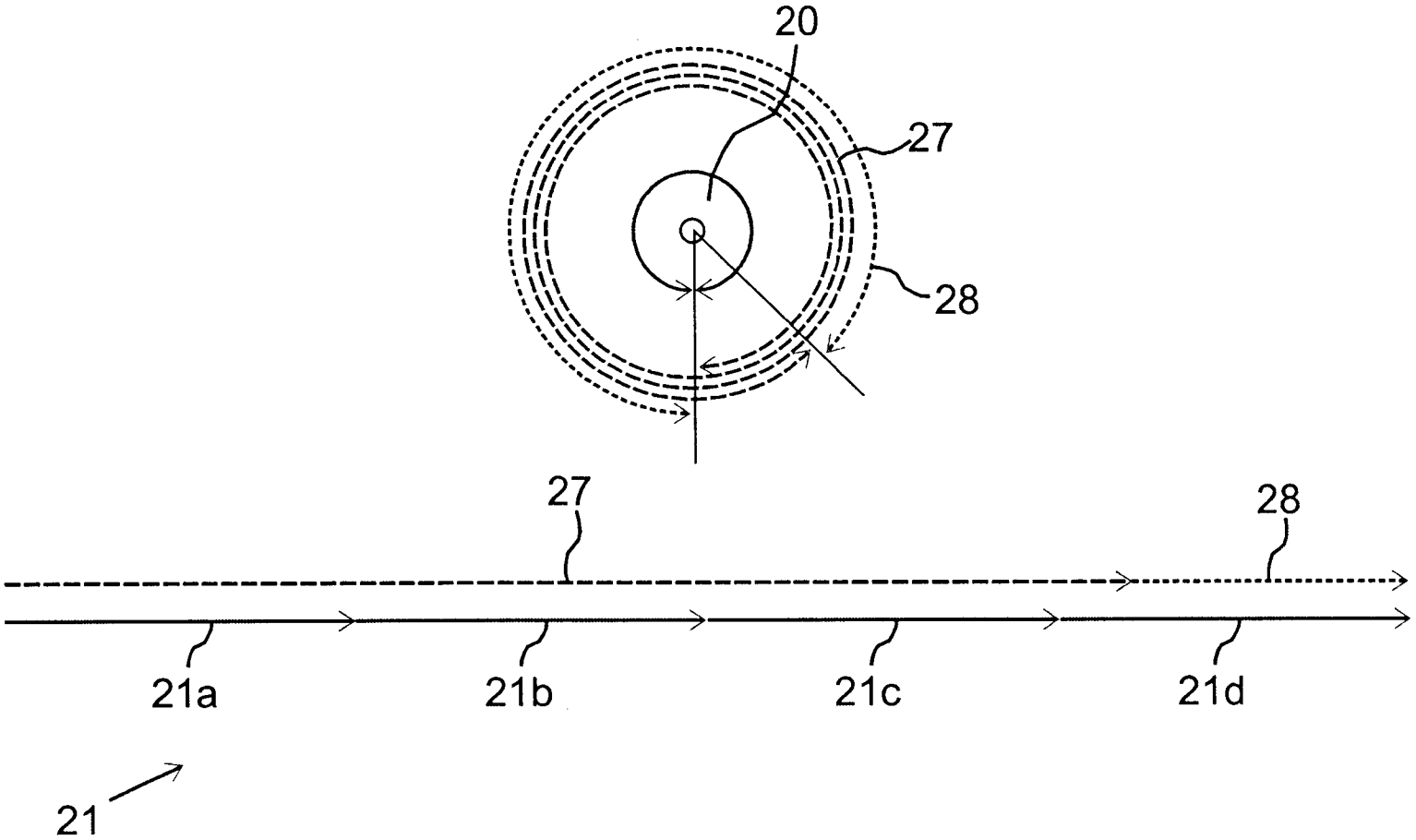
FIG. 2*b* shows a second rotating member for which a receiver can contain three complete images, and the projection of those images onto a single flat receiver.

In accordance with this invention, there is for every rotating member in the continuous printing process one interframe size satisfying Equ. 1 above. The special printing mode provided by the invention allows the paper feed time to be adjusted such that the resulting interframe size $S_{Interframe}$ satisfies Equ. 1. See FIGS. 2*a* and 2*b*, showing schematically the series of images 11 and 21 of rotating members 10 and 20 respectively. In FIG. 2*a*, receiver size 17 allows two complete images 11*a* and 11*b* of rotating member 10 to be printed on a single receiver. Interframe size 18 is sufficient to pass any remaining portion of rotating member 10 and reference the next receiver with the same starting point of rotating member 10 as was used in the first set 11 of images. Due to the differences in size, image 11*c* is incompletely printed. FIG. 2*b* shows three complete images 21*a*, 21*b*, and 21*c* printed on a single receiver of size 27 for rotating member 20, with interframe size 28 used to reference as in the previous example.

The invention provides a convenient operator interface to select the paper feed rate. For ease of use, the selections of various paper feed rates are labeled according to the rotating member of the continuous printing process to which the printed output is referenced.

In conjunction with the variable paper feed rate, the special printing mode according to this invention also allows the continuous printing process to operate at non-production setpoints. Such special setpoints for the electrophotographic printing process include, for example, the ability to operate at zero-offset voltage printing wherein the primary film voltage is essentially equal to the toning bias voltage. Such operating setpoints in conjunction with the selected paper feed time will produce zero-offset voltage print image artifacts of the photoconductor drum or the toning bias roller without the exposure step. Since the circumference of the photoconductor drum and the toning bias roller are very likely different the zero-volt offset printing mode is to be selected for the paper feed rate imaging for both of these examples. For other rotating members of the continuous printing process a flat field exposure yielding a uniform toner laydown might be most suited to image any artifacts caused by each such rotating member. Examples for the latter are the fuser systems and any of its rotating members or the transfer roller system, intermediate or direct transfer.

One or more rotating members used in a printing process may exceed in circumference the length of the largest receiver used in the diagnostic process. In this case, two or more receivers are required in order to produce one image of the entire surface of the large rotating member. For any rotating members of circumference greater than the receiver length, the following relation must be satisfied:

$$n*S_{rec}\geqq\pi*d_{rot_member} \quad \text{(Equ. 2a)}$$

where n is a positive integer representing the number of receivers required to obtain a single complete image of such a large rotating member. Several such images must be collected, collated, and compared in order to reveal repeated appearances of artifacts in the same relative circumferential position on the large rotating member.

Equ. 2a can be written as:

$$n \geq \frac{\pi * d_{\text{rot_member}}}{S_{rec}}. \quad \text{(Equ. 2b)}$$

It is preferable to make n, an integer, as small as possible in order to minimize the number of receivers needed to produce a complete image of the large rotating member. The following equation gives the smallest usable value for n:

$$n = \left\lceil \frac{\pi * d_{\text{rot_member}}}{S_{rec}} \right\rceil, \quad \text{(Equ. 3)}$$

where ⌈and⌉ signify the ceiling, or round-upwards, function for the enclosed value.

Whenever $S_{Interframe}$ must be greater than 0, it is assumed that $0<S_{Interframe}\leqq S_{rec}$. In this case, two complete revolutions of the large rotating member will be required in order to capture a complete image of the large rotating member on a series of receivers. The second revolution is required to capture images of the surface areas missed due to the passage of interframe spaces during the first revolution.

To reference the feeding of receivers to the appropriate circumferential points on the rotating member requires setting $S_{Interframe}$ so that $$n*(S_{rec}+S_{Interframe})=\pi*d_{rot_member} \quad \text{(Equ.4a)}$$

Solving this equation for $S_{Interframe}$ gives:

$$S_{Interframe} = \left[\frac{\pi * d_{\text{rot_member}}}{n}\right] - S_{rec} \quad \text{(Equ. 4b)}$$

Figure 3A:
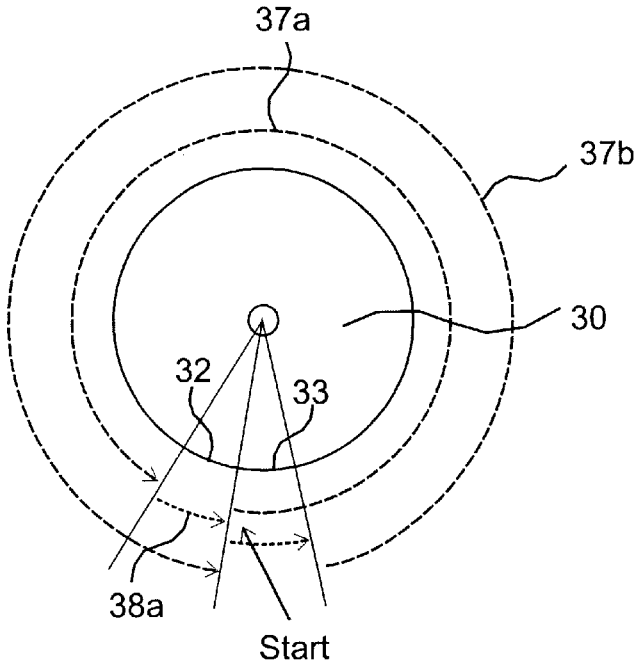
FIG. 3*a* shows a large rotating member for which a single receiver can contain only an almost-full image, and the projection of a complete image onto two flat receivers with overlap in portions of the image.
Figure 3A:
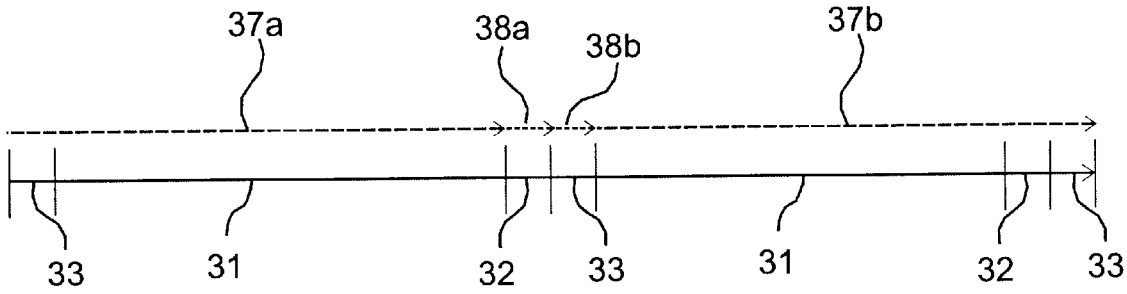
Figure 3B:
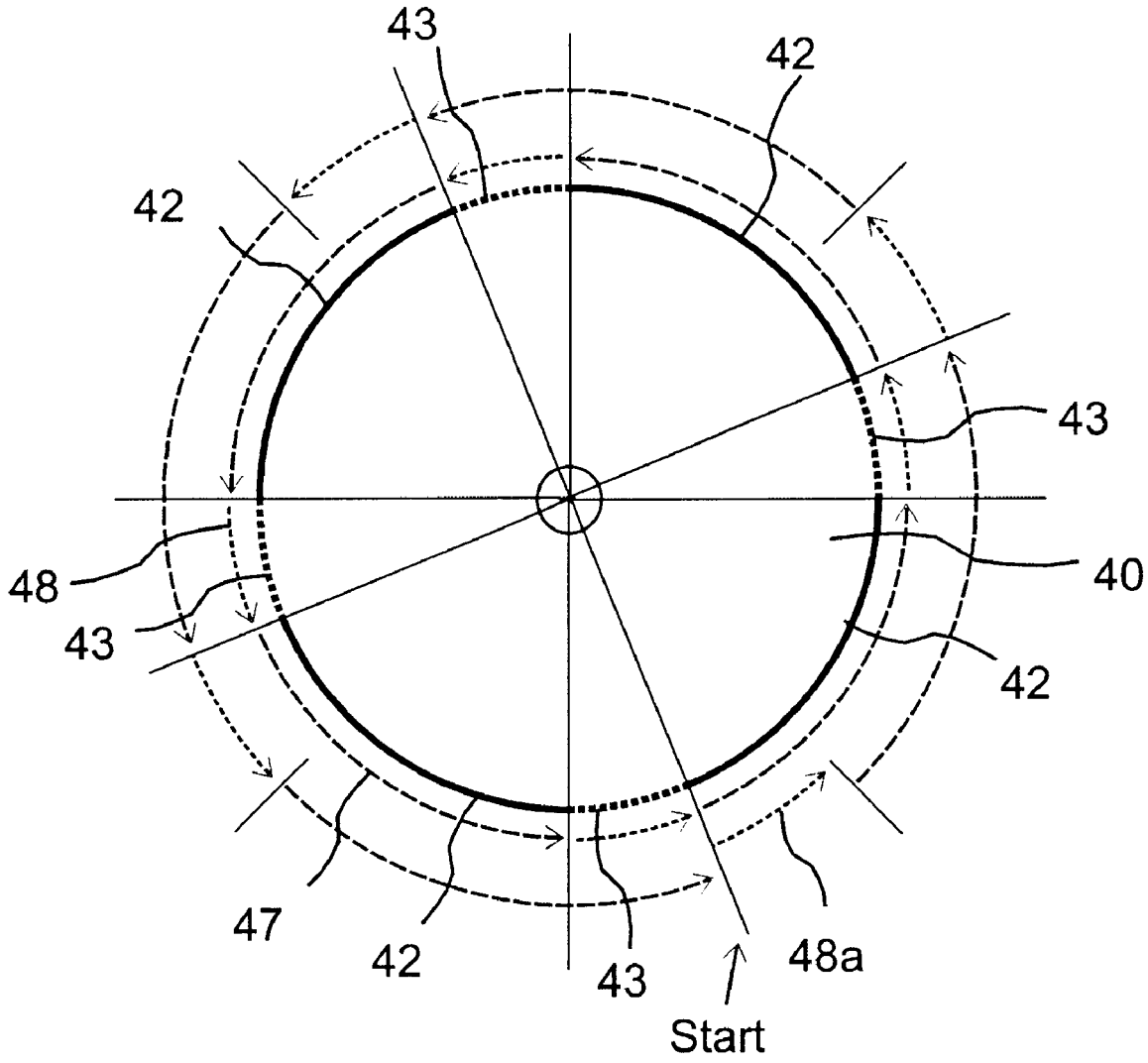
FIG. 3*b* shows a large rotating member for which a single receiver can contain only a fractional image, and the projection of a complete image onto eight flat receivers with overlap in portions of the image.

The invention obtains complete images of large rotating member surfaces as follows. Refer to FIGS. 3*a* and 3*b*. After one complete revolution of the selected rotating member has been completed and a first set of receivers has been printed, the interframe interval is increased, and a second complete revolution of the rotating member is completed while feeding another set of receivers. In FIG. 3*a*, the circumference of rotating member 30 is slightly larger than the length 37 of the receiver. To image the complete surface of rotating member 30, the normal interframe interval 38*a* is augmented by a delay interval 38*b* between successive feeds of receivers 37*a,* 37*b.* In the image on first receiver 37*a,* sector 32 of the circumference of rotating member 30 is not imaged, and sector 33 is imaged. The delay interval 38*a* causes the image on second receiver 37*b* to begin after sector 33, omitting it, but the final portion of second receiver 37*b* will include an image of sector 32, missed on first receiver 37*a*. Although much of the surface is imaged twice, all of the surface is imaged at least once. The added interframe interval 38*b* simply serves as a delay interval to allow image capture for the portion 32 of rotating member 30 not imaged on the first receiver 37*a*.

The upper portion of FIG. 3*a* shows the actual profile of a rotating member, and the lower portion of FIG. 3*a* shows the imaging process projected onto a flat time line.

FIG. 3*b* shows a rotating member 40. In FIG. 3*b,* the circumference 41 of rotating member 40 is more than four times larger than the length 47 of the receiver. In this case, interframe interval 48 is adjusted to produce four images of surface areas 42 of member 40, with surface areas 43 not imaged due to the passage of the interframe intervals during imaging. On the completion of the first series of images, the invention inserts an extra interframe interval or delay interval 48*a,* and the second series of receivers captures images of surface areas 43. As in the situation illustrated in FIG. 3*a,* two sets of receivers are required for a single complete image of the large rotating member.

In general, this method captures the interframe portions of the surface of the rotating member not printed in the first revolution. The invention references these interframe portions to the same area of each of the second set of receivers. Due to any size difference between $S_{rec}$ and $S_{Interframe}$, however, the second set of receivers will show some segment of $S_{rec}$ already printed in the first set.

The two sets of receivers described here constitute only one complete image of the full surface of the rotating member. In order to verify the repetition of image artifacts caused by a given rotating member, multiple pairs of sets may be needed.

A scale printout technique is used both to facilitate collation of the receiver images, and to convey to the user which portion of the surface of a specific rotating member is visible in each specific receiver image. A sequence number is printed on each receiver to correlate the image on each receiver with a specific portion of the circumference of the rotating member under test, along with an identifier for that rotating member. The user may then collate the receivers and locate both the rotating member and the area of that rotating member producing image artifacts visible on the receivers.

The invention's embodiment described above applies to a continuous printing process. In such a process the receiver is detected after feeding, and the successive steps of the printing process are referenced to the leading edge of said fed receiver. In the above embodiment, the successive steps resulting in the printed output are triggered by signals derived from the detection of the leading edge of the receiver after feeding.

In contrast to the above embodiment of this invention, a further embodiment supports printing processes which trigger the feeding of the receiver and all other successive steps of the printing process by a master timing mark. For example, the feeding of the receiver in printing processes employed in machines such as the KODAK 2100, Digi-Source 9110 or Digimaster 9110 are triggered by timing markings permanently fixed on the photoconductive belt. For these types of printing processes, a variable feed rate for the receiver might be difficult to implement. Therefore, in this further embodiment of the invention, the imaging of rotating members of the continuous printing process is achieved by printing at a fixed predetermined print production rate of the printing process while printing an image resembling a scale in the print process direction. This scale image is also produced in the continuous printing process when printing multiple images required for rotating members larger than the receivers used.

The image of such a printed scale contains marks that allow the service engineer to collate and align successive prints to provide a continuous image of the circumference of each rotating member. Each printed scale provides a first, common, reference mark and a multitude of secondary marks on each printed image. Each of the distances on the printed scale (between the common reference mark and any single secondary mark) corresponds to the circumference of the rotating member of the printing process. Conveniently, said secondary marks are labeled according to the subsystem and/or printing step they are associated with via the circumference of its rotating member.

Figure 4:
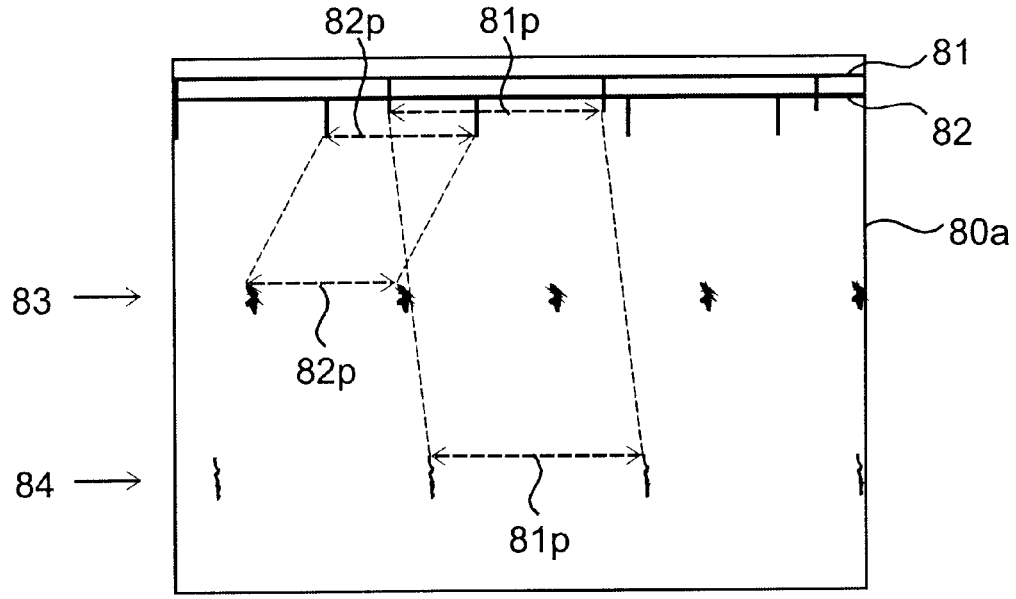
FIG. 4 shows two different receivers from a single diagnostic process for identification of distinct artifact sources, each receiver showing the master timing marks and secondary marks referenced to the leading edge of the receiver.
Figure 4:
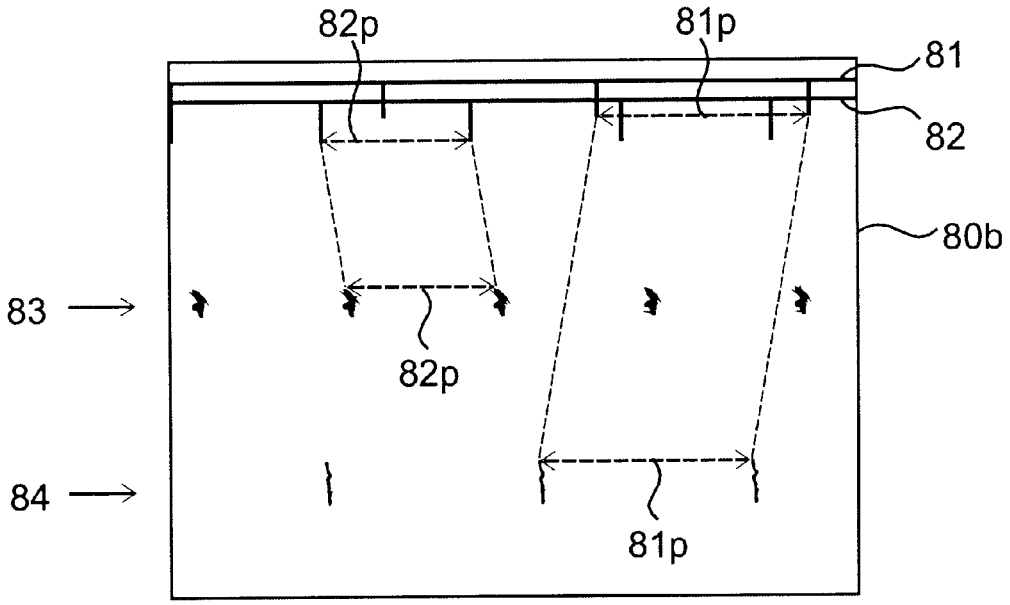

See FIG. 4, which shows two different images 80*a* and 80*b* from a system using timing marks. To correlate artifacts 83, 84 with the rotating members that produced them, the user refers to printed scales 81 and 82 showing marks at periodic intervals 81*p* and 82*p* respectively matching the circumferences of the members being tested. The appearance of identical artifacts in line at a separation matching one of the intervals marked will associate those artifacts with that interval, which in turn is identified with a particular rotating member. In FIG. 4, intervals between artifacts 83 match the interval 82*p* of scale 82, while intervals between artifacts 84 match the interval 81*p* of scale 81.

Figure 5:
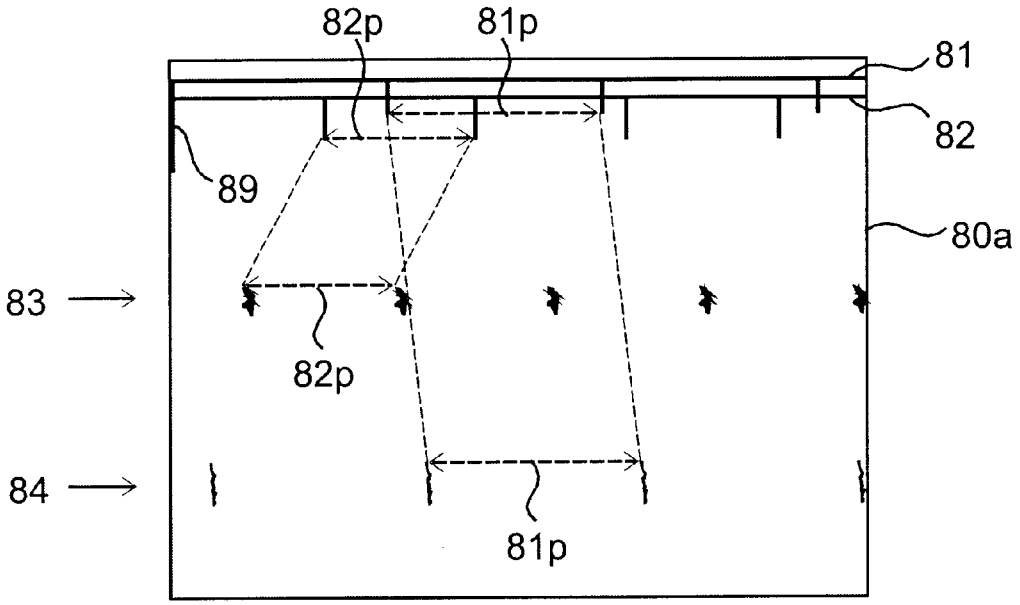
FIG. 5 shows two different receivers from a single diagnostic process for identification of distinct artifact sources, each receiver showing master timing marks and secondary marks referenced to the rotating member under study.
Figure 5:
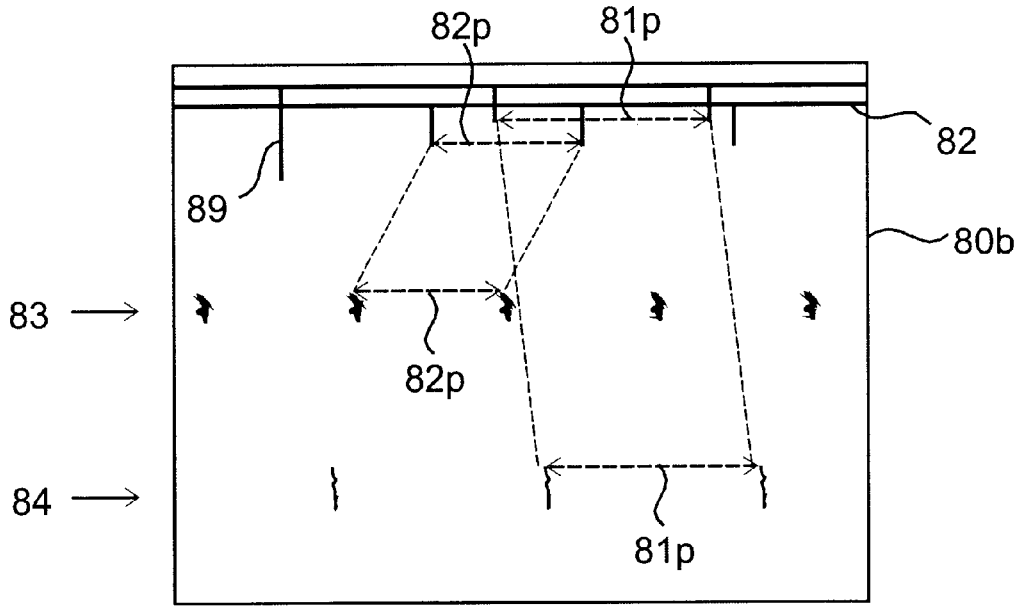

FIG. 5 shows an alternate embodiment of the scales and marked intervals, wherein the scales 81 and 82 are printed with reference to the position of the rotating member rather than the position of the receiver. In this embodiment, a first common reference mark 89 appears in a different position on each receiver sheet so as to maintain across all receiver sheets the same offset between scale markings and the marks produced by image artifacts.

Figure 6:
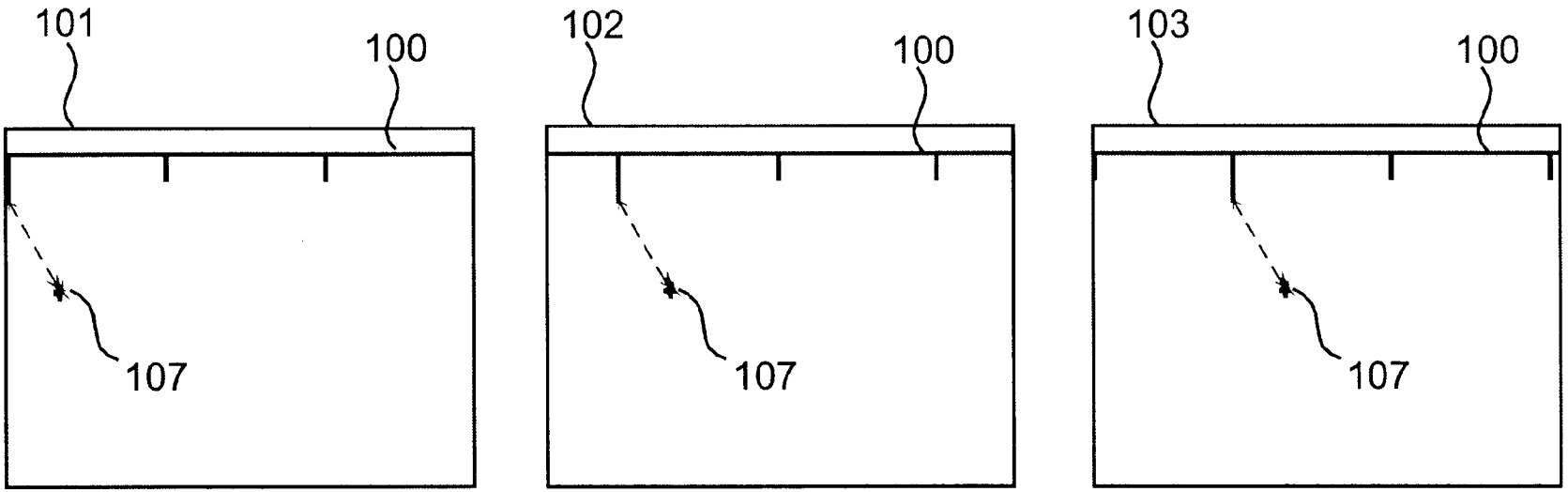
FIG. 6 shows three receivers from a single diagnostic process for identification of distinct artifact sources, each receiver showing a single artifact offset differently on each sheet.

When a continuous printing system using large rotating members is being tested, the same process is used. This case, however, requires that separate receiver sheets be sequenced and the rotating member scale be printed over multiple sheets in such a way as to identify the circumferential interval across sheets. See FIG. 6. Here a large rotating member is of sufficient size that a single image artifact from that member will only appear at most one time per receiver sheet. To facilitate detection and maintenance of such artifacts, a scale 100, referenced to the large rotating member, is printed across the set of receivers 101, 102, 103 to mark the location of the image artifact 107.

Figure 7:
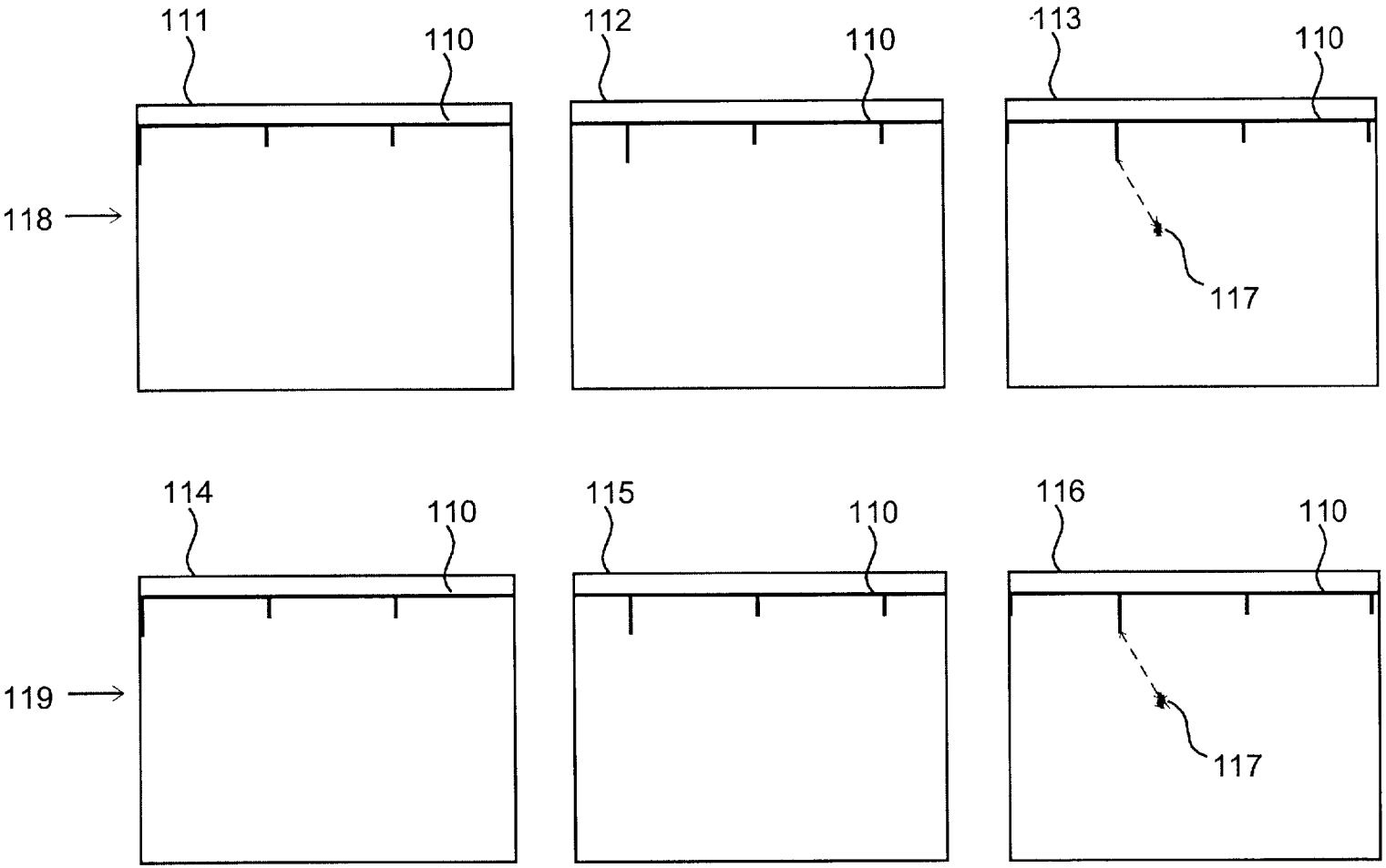
FIG. 7 shows six receivers from two diagnostic passes for identification of distinct artifact sources, one receiver in each pass showing a single artifact.

For large rotating members of a size to require multiple receivers for a single complete image, see FIG. 7. In the figure, multiple sets 118, 119 of receivers 111 through 116 are required to provide a complete image of the rotating member surface. Scale 110 carries reference marks and other indicators to locate an image artifact 117 on the rotating member.

Figure 8:
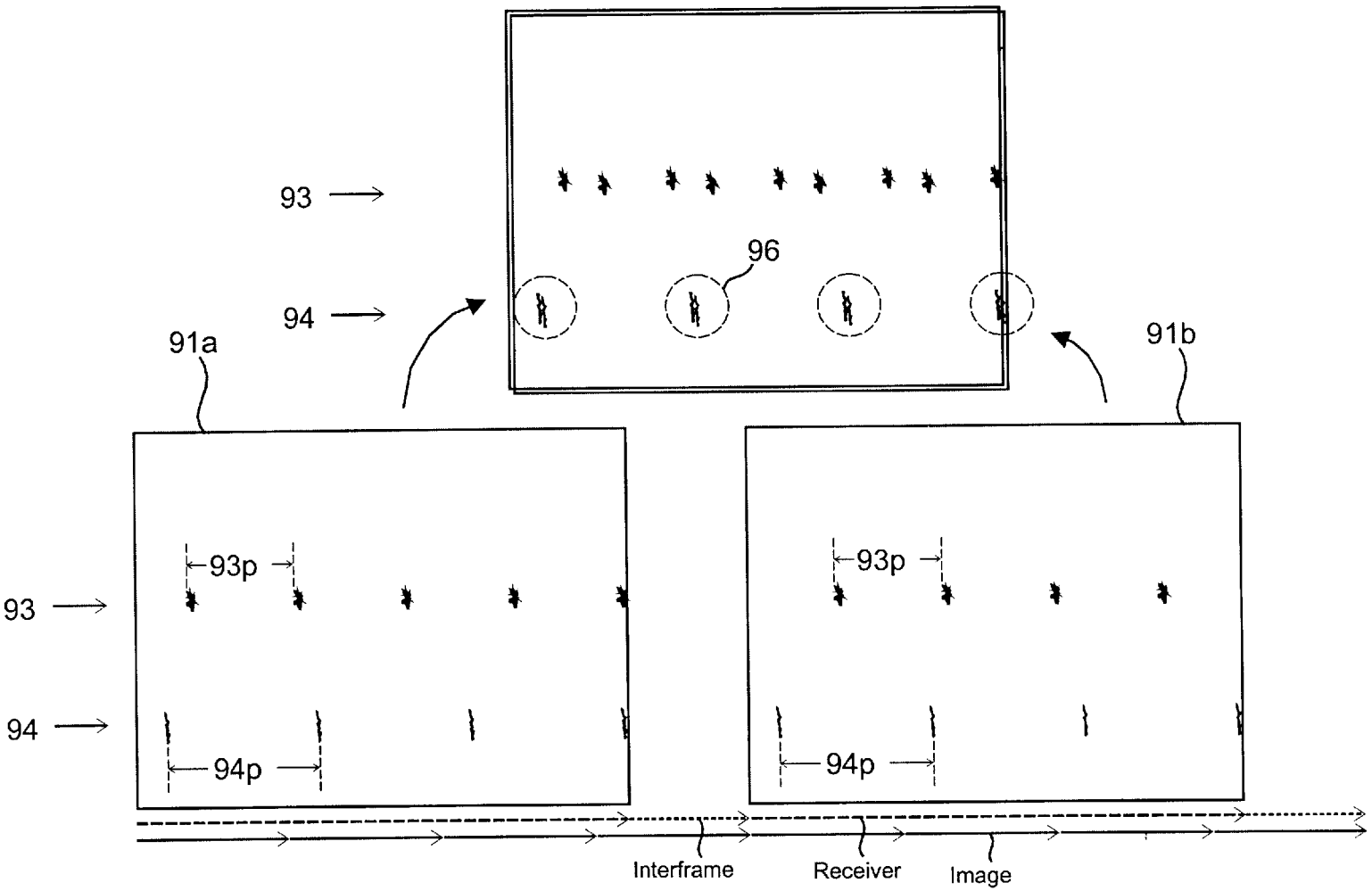
FIG. 8 shows the artifact comparison process for two receiver images referenced for a single rotating member source.

In general, the invention facilitates easy and effective cause analysis of image artifacts introduced by any of the rotating members of the continuous printing process. The special program according to this invention references the feed rate of the receiver to a selected rotating member of the printing process so that artifacts caused by it will print in one and the same location on each print. FIG. 8 illustrates the case of a receiver which can image multiple revolutions of a particular rotating member. In FIG. 8, artifacts 93 and 94 are visible on receivers 91*a* and 91*b*. Artifacts 93 are apparently from one source, and artifacts 94 are from a different source, since their respective periods of repetition 93*p* and 94*p* are different. The user determines which artifact is due to the rotating member being tested by laying receivers 91*a* and 91*b* together and comparing the locations of the repeating artifacts. Artifacts 94 from the rotating member under test will appear in the same locations 96 on each receiver, while artifacts 93 from another rotating member will appear in different locations on each receiver due to the different diameters of the rotating members and the consequent non-referencing of rotation. Together with non-print-production-like electrophotographic setpoints, the visibility of artifacts is ensured for the subsystem under investigation. The utility of this special program is enhanced according to this invention via a user interface that relates intuitively the paper feed rate, the electrophotographic setpoints of the printing process, and the rotating member under investigation.

The user interface provides drop-down menus for the user to specify a rotating member to be tested.

CONCLUSION, RAMIFICATIONS, AND SCOPE OF INVENTION

From the above descriptions, figures and narratives, the invention's advantages in isolating rotating member image artifacts should be clear.

Although the description, operation and illustrative material above contain many specificities, these specificities should not be construed as limiting the scope of the invention but as merely providing illustrations and examples of some of the preferred embodiments of this invention.

Thus the scope of the invention should be determined by the appended claims and their legal equivalents, rather than by the examples given above.

What is claimed:

1. An apparatus for identifying root causes of image artifacts visible in the printed output of an electrophotographic printer, comprising:

a printing process control computer, further comprising a processor, a memory subsystem, a storage subsystem, and a plurality of printer component interfaces;

one or more rotating members of an electrophotographic printer;

for each rotating member, an artifact image of any non-uniformities of the rotating member's surface;

one or more receivers on which to print artifact images;

an electrophotographic printer marking engine for printing the artifact images on the receivers;

a program stored and executing on the process control computer for selecting one of the rotating members via a printer component interface;

a program stored and executing on the process control computer for referencing the selected rotating member to a leading edge of a receiver artifact image via a printer component interface.

2. The apparatus of claim 1, further comprising:

a program stored and executing on the process control computer for setting the primary film voltage of the printer via a printer component interface;

a program stored and executing on the process control computer for setting the toning bias voltage of the printer via a printer component interface;

a program stored and executing on the process control computer for producing a flat field exposure yielding substantially uniform toner laydown via a printer component interface.

3. The apparatus of claim 2 wherein a receiver contains one or more complete artifact images of the selected rotating member.

4. The apparatus of claim 2 wherein a complete artifact image of the selected rotating member comprises partial artifact images printed on more than one receiver.

5. The apparatus of claim 2 wherein the primary film voltage and the toning bias voltage are set substantially equal in order to produce about a zero offset voltage.

6. The apparatus of claim 2 wherein the artifact image is a flat-field exposure.

7. The apparatus of claim 2 wherein the program for referencing the selected rotating member to the leading edge of the receiver alters a receiver interframe interval to accomplish referencing.

8. The apparatus of claim 7 wherein the program for referencing the selected rotating member with the leading edge of the receiver selects the receivers from one of a plurality of supplies of the receivers, wherein each supply of the receivers includes receivers of different size.

9. An apparatus for identifying root causes of image artifacts visible in the printed output of an electrophotographic printer, comprising:

a printing process control computer, further comprising a processor, a memory subsystem, a storage subsystem, and a plurality of printer component interfaces;

one or more rotating members of an electrophotographic printer;

for each rotating member, an artifact image of any non-uniformities of the rotating member's surface;

one or more receivers on which to print artifact images;

an electrophotographic printer marking engine for printing the artifact images on the receivers;

a program stored and executing on the process control computer for selecting one of the rotating members via a printer component interface;

a program stored and executing on the process control computer for referencing the selected rotating member with a scale printed on each receiver image.

10. The apparatus of claim 9 wherein the program prints jobs with two or more sequential receivers and numbers the receivers with indicia to identify the sequential order of the receivers.

11. The apparatus of claim 9 wherein the program prints jobs with two or more receivers in a sequential order, prints scales on each receiver and prints indicia on the receivers to indicate their sequential order.

12. The apparatus of claim 9, further comprising:

a program stored and executing on the process control computer for setting the primary film voltage of the printer via a printer component interface;

a program stored and executing on the process control computer for setting the toning bias voltage of the printer via a printer component interface;

a program stored and executing on the process control computer for producing a flat field exposure yielding substantially uniform toner laydown via a printer component interface.

13. The apparatus of claim 12 wherein a receiver contains one or more complete artifact images of the selected rotating member.

14. The apparatus of claim 12 wherein a complete artifact image of the selected rotating member comprises partial artifact images printed on more than one receiver.

15. The apparatus of claim 12 wherein the primary film voltage and the toning bias voltage are set substantially equal in order to produce substantially zero offset voltage.

16. The apparatus of claim 12 wherein the artifact image is a flat-field exposure.

17. The apparatus of claim 12 wherein the program for referencing the selected rotating member to the leading edge of a receiver alters the receiver interframe interval to accomplish referencing.

18. The apparatus of claim 17 wherein the program for referencing the selected rotating member to the leading edge of a receiver selects a receiver of a specific length to facilitate referencing.

19. A method of identifying root causes of image artifacts visible in the printed output of an electrophotographic printer, comprising the steps of:

altering the printer's operating settings so as to produce an image with maximum sensitivity to artifacts produced by rotating members of the electrophotographic printing process;

referencing a leading edge of each receiver image to each rotating member of the electrophotographic printing process in turn;

for each rotating member of the electrophotographic printing process, producing two or more referenced receiver images on a plurality of receivers for visual comparison.

20. The method of claim 19 wherein the step of altering the printer's operating settings further comprises the step of setting the primary film voltage and the toning bias voltage substantially equal.

21. The method of claim 20 wherein the step of altering the printer's operating settings further comprises the step of selecting a flat-field exposure.

22. The method of claim 19 wherein the step of referencing the leading edge of each receiver image to each rotating member further comprises the step of altering the receiver interframe interval to accomplish referencing.

23. The method of claim 22 wherein the step of referencing the leading edge of each receiver image to each rotating member further comprises the step of selecting a receiver of a specific length to facilitate referencing.

24. A method of identifying root causes of image artifacts visible in the printed output of an electrophotographic printer, comprising the steps of:

altering the printer's imaging voltage set points so as to produce an image with maximum sensitivity to artifact variations produced by rotating members of the electrophotographic printing process;

referencing the printing of a leading edge of a plurality of comparison scales to each rotating member of the electrophotographic printing process in turn;

for each rotating member of the electrophotographic printing process, producing two or more images, each image incorporating the referenced plurality of comparison scales, on a plurality of receivers for visual comparison.

25. The method of claim 24 comprising the further step printing two sets of receivers and delaying the second set of receivers by a known delay time so that the second set of receivers overlaps interframe regions of the first set of receivers.

26. The method of claim 24 wherein the step of altering the printer's operating settings further comprises the step of setting the primary film voltage and the toning bias voltage substantially equal.

27. The method of claim 25 wherein the step of altering the printer's operating settings further comprises the step of selecting a flat-field exposure.

28. The method of claim 24 wherein the step of referencing the leading edge of each receiver image to each rotating member further comprises the step of altering the receiver interframe interval to accomplish referencing.

29. The method of claim 28 wherein the step of referencing the leading edge of each receiver image to each rotating member further comprises the step of selecting a receiver of a specific length to facilitate referencing.

30. An apparatus for identifying root causes of image artifacts visible in the printed output of an electrophotographic printer, comprising:

a printing process control computer, further comprising processor means, memory means, storage means, and printer component interface means;

one or more rotating members of an electrophotographic printer;

for each rotating member, an artifact image of any non-uniformities of the rotating member's surface;

one or more receivers on which to print artifact images;

means for printing the artifact images on the receivers;

means for selecting one of the rotating members;

means for referencing the selected rotating member to a leading edge of a receiver artifact image.

31. The apparatus of claim 30, further comprising:

means for setting the primary film voltage of the printer;

means for setting the toning bias voltage of the printer;

means for producing a flat field exposure yielding substantially uniform toner laydown.

32. The apparatus of claim 30 further comprising means for printing a scale image on the receivers wherein the scale image represents a circumference of at least one rotating member.

33. The apparatus of claim 32 wherein the scale image represents the circumferences of two or more rotating members.

34. The apparatus of claim 32 further comprising means for selecting between or among two or more sizes of available receivers.

35. The apparatus of claim 34 wherein a receiver of optimum size is selected.

36. The apparatus of claim 34 wherein the larger or largest size receiver is selected.

37. The apparatus of claim 30 further comprising means for printing a scale image on the receivers wherein the scale image represents the position of one or more rotating members with respect to the receivers.

* * * * *